US008967620B2

(12) United States Patent
Ishikura et al.

(10) Patent No.: US 8,967,620 B2
(45) Date of Patent: Mar. 3, 2015

(54) SHEET TRANSPORT DEVICE

(71) Applicant: Fuji Xerox Co., Ltd., Minato-ku, Tokyo (JP)

(72) Inventors: Kenichi Ishikura, Kanagawa (JP); Naoya Kamigaito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/956,874

(22) Filed: Aug. 1, 2013

(65) Prior Publication Data

US 2014/0203503 A1 Jul. 24, 2014

(30) Foreign Application Priority Data

Jan. 21, 2013 (JP) ..... 2013-008029

(51) Int. Cl.
*G03G 21/00* (2006.01)
*B65H 5/06* (2006.01)
*G03G 21/16* (2006.01)

(52) U.S. Cl.
CPC ..... *B65H 5/062* (2013.01); *G03G 21/16* (2013.01); *G03G 2221/1675* (2013.01)
USPC ..... 271/273; 271/264; 399/124; 399/121

(58) Field of Classification Search
CPC ..... G03G 21/16; G03G 2221/1675
USPC ..... 271/264, 273; 399/124, 121
See application file for complete search history.

(56) References Cited

U.S. PATENT DOCUMENTS

| | | | | |
|---|---|---|---|---|
| 5,802,426 | A * | 9/1998 | Miyazaki et al. | 399/113 |
| 8,521,063 | B2 * | 8/2013 | Saito et al. | 399/121 |
| 2006/0093397 | A1 * | 5/2006 | Yamaoka | 399/110 |
| 2007/0154238 | A1 * | 7/2007 | Yokoi | 399/124 |
| 2010/0278557 | A1 * | 11/2010 | Somemiya et al. | 399/124 |

FOREIGN PATENT DOCUMENTS

| | | | |
|---|---|---|---|
| JP | 04007240 | A * | 1/1992 |
| JP | 9-258507 | A | 10/1997 |
| JP | 2010-285253 | A | 12/2010 |

* cited by examiner

*Primary Examiner* — Luis A Gonzalez
(74) *Attorney, Agent, or Firm* — Sughrue Mion, PLLC

(57) ABSTRACT

A sheet transport device includes a device body that transports a sheet; a pair of transport rollers that come into contact with each other and transport the sheet toward a downstream side in a transport direction of the sheet; a transport member that guides and transports the sheet toward the transport rollers; and an open and close member that opens and closes a side surface of the device body. One of the transport rollers is provided at the device body and the other transport roller is provided at the transport member, and the transport member is rotatable around an axis parallel to the transport rollers. When the open and close member moves to an open position at which the side surface is open, the open and close member rotates around the axis and the contact between the transport rollers is allowed to be released.

5 Claims, 9 Drawing Sheets

SHEET TRANSPORT DEVICE

CROSS-REFERENCE TO RELATED APPLICATIONS

This application is based on and claims priority under 35 USC 119 from Japanese Patent Application No. 2013-008029 filed Jan. 21, 2013.

BACKGROUND

The present invention relates to a sheet transport device.

SUMMARY

According to an aspect of the invention, there is provided a sheet transport device including a device body that transports a sheet; a pair of transport rollers that come into contact with each other and transport the sheet toward a downstream side in a transport direction of the sheet; a transport member that guides and transports the sheet toward the pair of transport rollers; and an open and close member that opens and closes a side surface of the device body. One of the pair of transport rollers is provided at the device body and the other transport roller is provided at the transport member, and the transport member is rotatable around an axis that is parallel to the pair of transport rollers. When the open and close member moves to an open position at which the side surface is open, the open and close member rotates around the axis and the contact between the pair of transport rollers is allowed to be released.

BRIEF DESCRIPTION OF THE DRAWINGS

Exemplary embodiments of the present invention will be described in detail based on the following figures, wherein.

DETAILED DESCRIPTION

Figure 1:
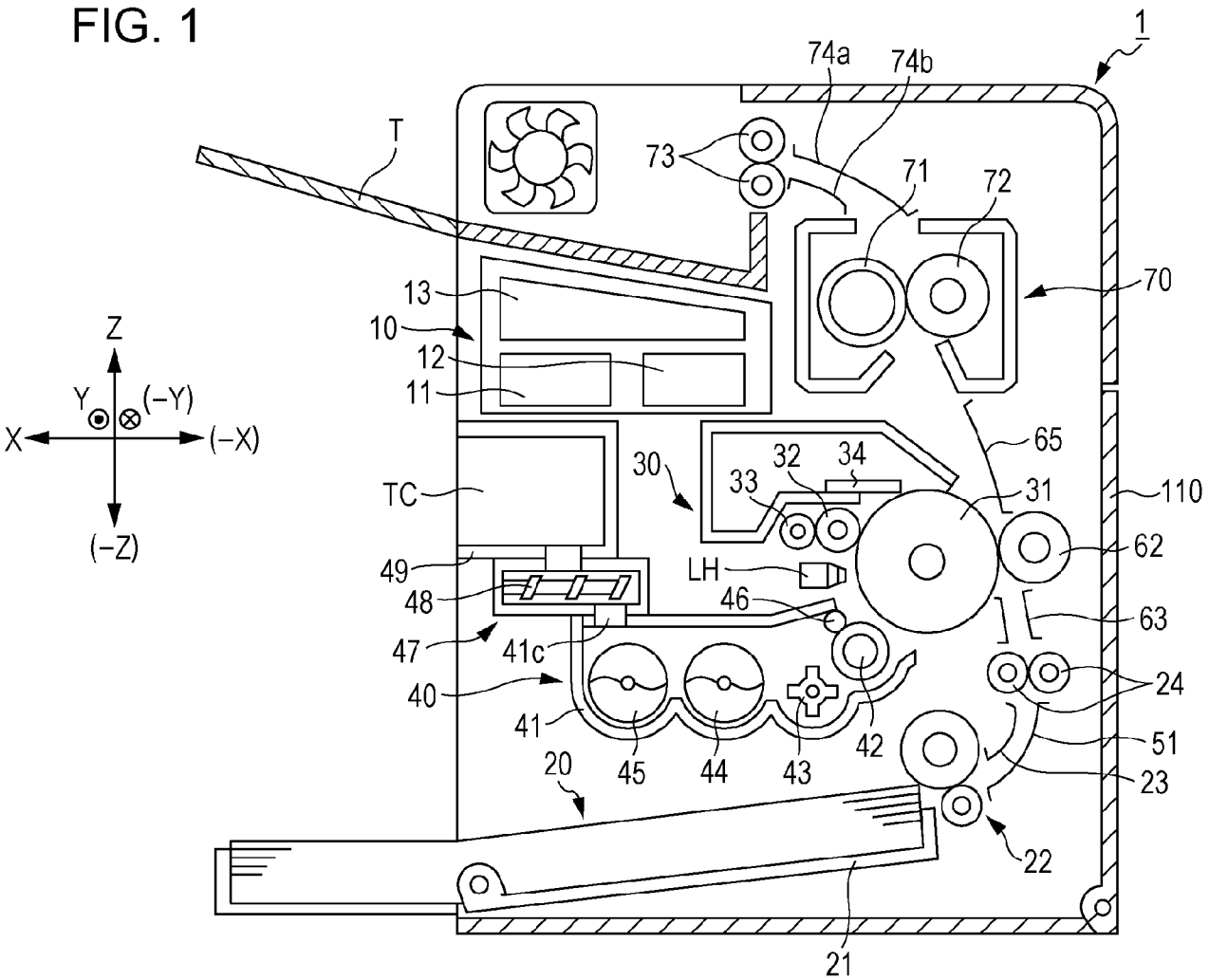
FIG. 1 is a schematic vertical section illustrating an inner configuration of an image forming apparatus.

Exemplary embodiments and specific examples of the invention are described below in detail with reference to the drawings. However, the invention is not limited to the exemplary embodiments or the specific examples.

Also, in the description with reference to the drawings, the drawings are merely schematically illustrated, and it should be noted that the ratios of illustrated dimensions may differ from the ratios of actual dimensions. Illustration of members other than members required for the description is omitted for easier understanding.

In the drawings, it is assumed that an X-axis direction is a front-rear direction, a Y-axis direction is a left-right direction, and a Z-axis direction is an up-down direction for easier understanding of the description.

First Exemplary Embodiment

(1) General Configuration and Operation of Image Forming Apparatus

FIG. 1 is a schematic vertical section illustrating an inner configuration of an image forming apparatus 1 according to this exemplary embodiment.

A general configuration and an operation of the image forming apparatus 1 are described below with reference to the drawings.

The image forming apparatus 1 includes a control unit 10, a sheet feed unit 20, a photoconductor unit 30, a development unit 40, a sheet transport unit 50, a transfer and transport unit 60, and fixing unit 70 in a housing 100. An output tray portion T is formed at an upper surface (Z direction) of the image forming apparatus 1. A sheet having an image recorded thereon is output to and housed on the output tray portion T. Further, an open and close panel 110 is rotatably supported at a rear surface (−X direction) of the image forming apparatus 1. The open and close panel 110 opens the inside of the image forming apparatus 1, for example, when a clogged sheet is removed or the inside is inspected.

The control unit 10 includes a controller 11 that controls an operation of the image forming apparatus 1, an image processing device 12, an operation of which is controlled by the controller 11, and a power supply device 13. The power supply device 13 applies voltages to, for example, a charging roller 32, a development roller 42, and a transfer roller 62 (described later).

The image processing device 12 converts print information input from an external information transmit device (for example, a personal computer) into image information for latent-image formation, and outputs a driving signal to an exposure device LH at a predetermined timing. The exposure device LH of this exemplary embodiment is formed of an LED head having light emitting diodes (LEDs) arranged in a linear form.

The sheet feed unit 20 is provided in a bottom portion of the image forming apparatus 1. The sheet feed unit 20 includes a sheet stack plate 21. Multiple sheets serving as recording media are stacked on an upper surface of the sheet stack plate 21. The sheets, which are stacked on the sheet stack plate 21 and positioned in a width direction by a regulation plate (not illustrated), are drawn one by one from the upper side to the front side (−X direction) by a sheet draw portion 22. Then, the drawn sheet passes through a sheet guide 23 serving as a first transport unit fixed in the housing 100 and a sheet guide 51 serving as a second transport unit formed at the sheet transport unit 50, and is transported to a contact part of a pair of transport rollers 24 including a driving roller 24*a* and a driven roller 24*b*.

The sheet guide 51 has a curved shape, and guides the sheet drawn by the sheet draw portion 22 to the pair of transport rollers 24.

The photoconductor unit 30 is provided at the upper side (Z direction) of the sheet feed unit 20, and includes a photoconductor drum 31 serving as an image holding body that is rotationally driven. The charging roller 32, the exposure device LH, the development unit 40, the transfer roller 62, and a cleaning blade 34 are arranged along a rotation direction of the photoconductor drum 31. A cleaning roller 33 is arranged to face and contact the charging roller 32. The cleaning roller 33 cleans a surface of the charging roller 32.

The development unit 40 includes a development housing 41 that houses a developer therein. The development housing 41 includes therein the development roller 42 arranged to face the photoconductor drum 31, and a paddle wheel 43 arranged at the rear surface side, at the obliquely lower side of the development roller 42. The paddle wheel 43 stirs the developer and transports the developer toward the development roller 42. Further, a pair of augers 44 and 45 for stirring and transportation is arranged at the rear surface side of the paddle wheel 43. A layer regulation roller 46 is arranged near the development roller 42. The layer regulation roller 46 regulates a layer thickness of the developer.

A toner supply port 41*c* is formed at an upper surface at the front side (X direction) of the development housing 41. A toner supply mechanism 47 is coupled to the toner supply port 41*c*, and extends to the front. A supply auger 48 is rotatably supported in the toner supply mechanism 47. A cartridge holder 49 is coupled to a front end of the toner supply mechanism 47. A toner from a toner cartridge TC flows into the cartridge holder 49. The supply auger 48 is driven in accordance with a consumption amount of the toner by the development unit 40, and the developer is supplied from the toner cartridge TC to the development unit 40.

A surface of the rotating photoconductor drum 31 is electrically charged by the charging roller 32. Then, an electrostatic latent image is formed by latent-image forming light emitted from the exposure device LH. The electrostatic latent image formed on the photoconductor drum 31 is developed as a toner image by the development roller 42.

The transfer and transport unit 60 includes a sheet guide 63 that guides the sheet sent from the pair of transport rollers 24 to a transfer contact part, the transfer roller 62, a transport guide 65 that guides the sheet having the toner image transferred thereon to the fixing unit 70. The transfer and transport unit 60 is located at the downstream side of the pair of transport rollers 24 in a sheet transport direction, and is supported so that the transfer and transport unit 60 may come into contact with and be separated from the body of the image forming apparatus 1 through the open and close panel 110.

The power supply device 13 or other device controlled by the controller 11 applies a transfer voltage to the transfer roller 62. The transfer roller 62 transfers the toner image on the photoconductor drum 31 onto the sheet sent from the pair of transport rollers 24 and guided by the sheet guide 63.

The remaining toner on the surface of the photoconductor drum 31 is removed by the cleaning blade 34 and housed in the housing that supports the photoconductor drum 31. The surface of the photoconductor drum 31 is electrically charged again by the charging roller 32. The remaining substance which is not removed by the cleaning blade 34 and adheres to the charging roller 32 is caught by and accumulated on the surface of the cleaning roller 33 that rotates while contacting the charging roller 32.

The fixing unit 70 includes a pair of fixing rollers 71 and 72. A press region of the pair of fixing rollers 71 and 72 forms a fixing region.

The sheet having the toner image transferred thereon by the transfer unit is transported to the fixing unit 70 through the transport guide 65 in a state in which the toner image is not fixed. The toner image of the recording medium transported to the fixing unit 70 is fixed by an action of pressure and heat by the pair of fixing rollers 71 and 72. The sheet having the fixed toner image formed thereon is guided by transport guides 74*a* and 74*b*, and is output to the output tray portion T at the upper surface of the image forming apparatus 1 from an output roller pair 73.

(2) Configuration and Operation of Sheet Transport Section

Figure 2:
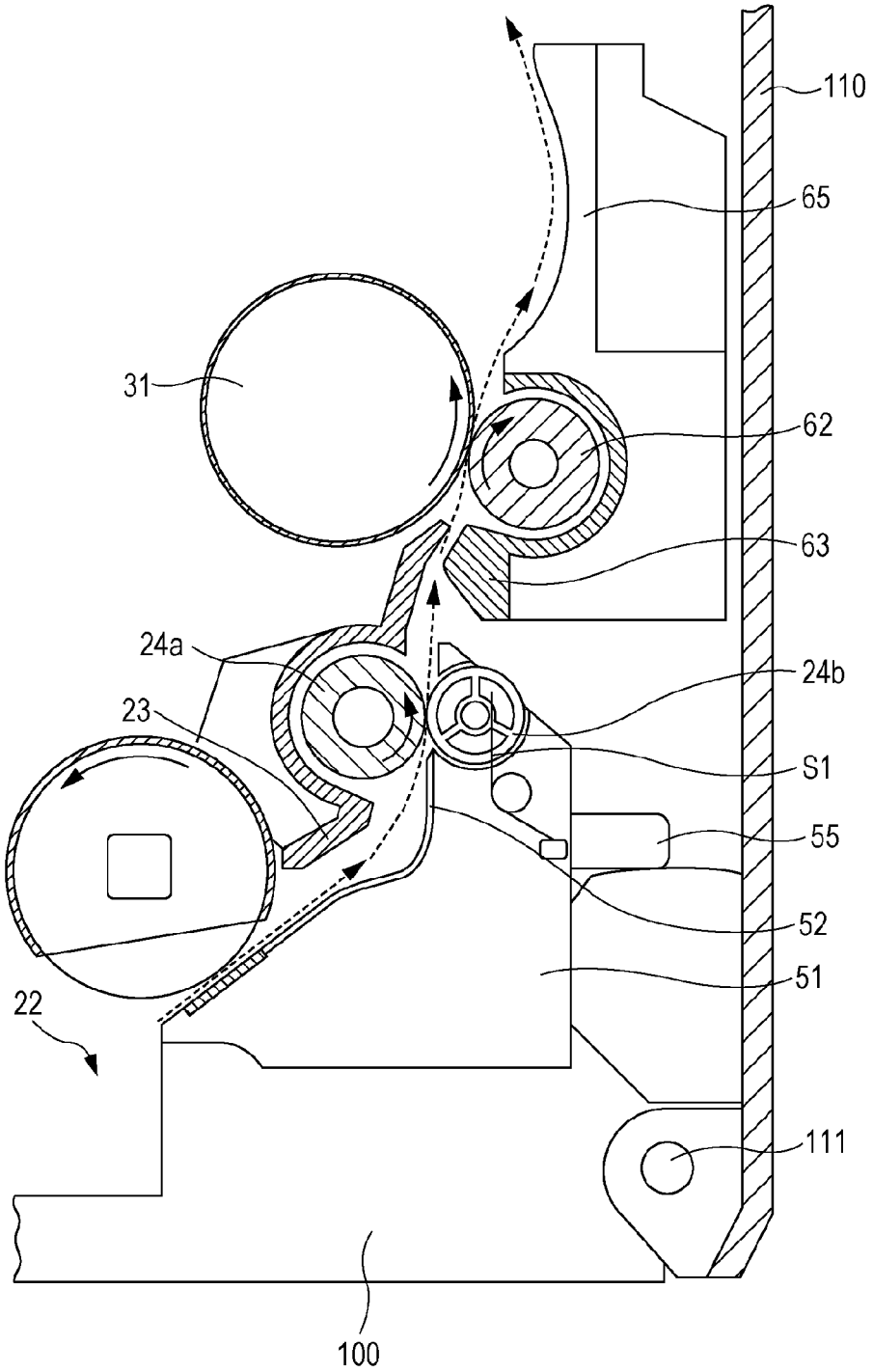
FIG. 2 is a schematic section illustrating an inner configuration and sheet transportation of a sheet transport section of the image forming apparatus.
Figure 3:
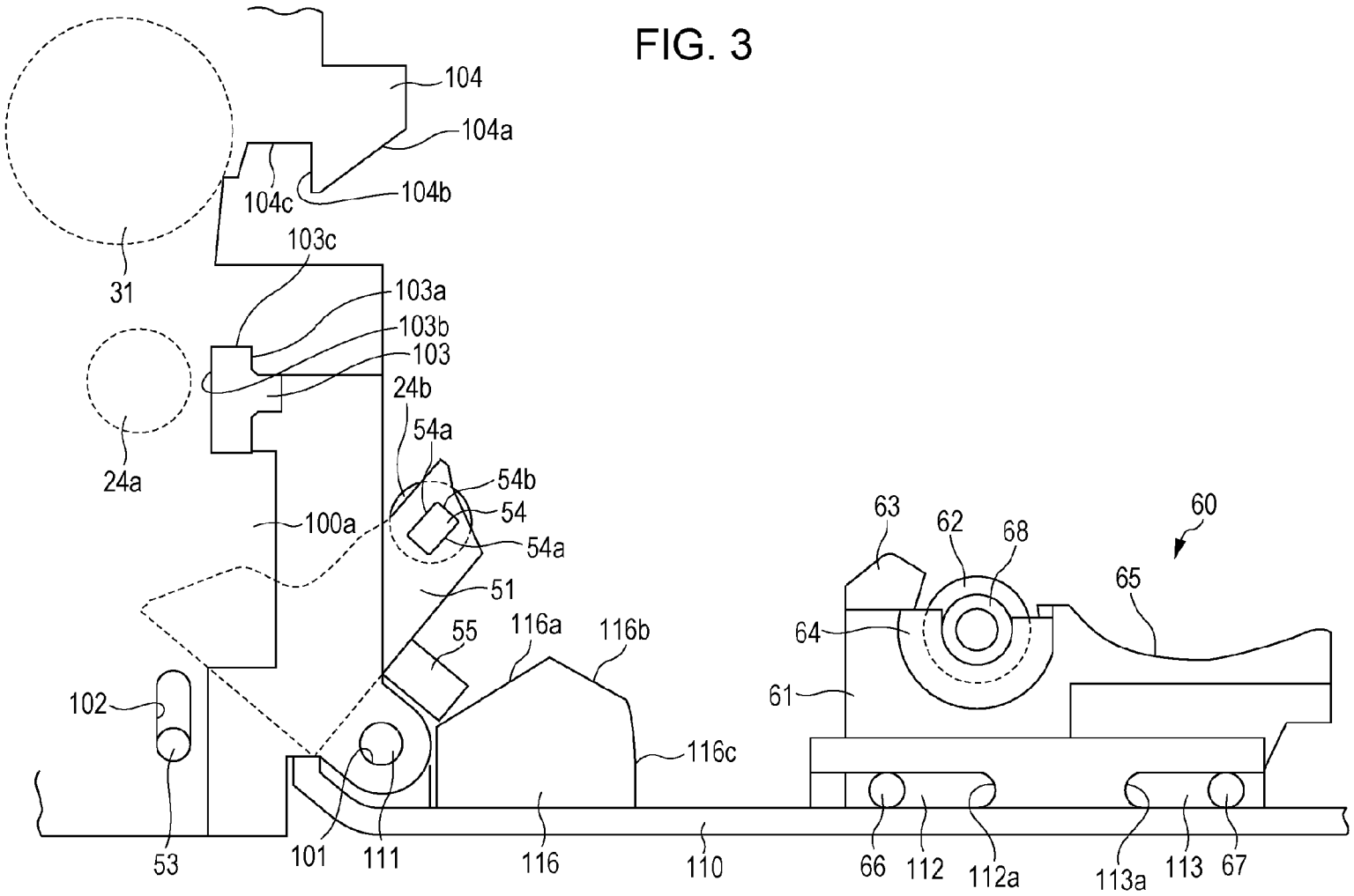
FIG. 3 is a schematic partial section illustrating the sheet transport section of the image forming apparatus.

FIG. 2 is a schematic section illustrating an inner configuration and sheet transportation of the sheet transport section of the image forming apparatus 1 according to this exemplary embodiment. FIG. 3 is a schematic partial section of the sheet transport section. The configuration and the operation of the sheet transport section of the image forming apparatus 1 are described below with reference to the drawings.

The sheet transport section includes the housing 100, the open and close panel 110, the sheet transport unit 50, and the transfer and transport unit 60.

(2.1) Housing

The housing 100 has an opening at the rear side (−X direction) and houses the photoconductor unit 30 and the development unit 40 in the opening.

The housing 100 includes both side plates 100*a*. First bearing portions 101 serving as the rotation center of the open and close panel 110 are formed at lower ends at the opening side of the both side plates 100*a* to penetrate through the both side plates 100*a* in a plate thickness direction. The first bearing portions 101 rotatably support rotation shaft portions 111 (described later) of the open and close panel 110.

Second bearing portions 102 are formed at the front side (X direction) of the first bearing portions 101. The second bearing portions 102 rotatably support rotation shaft portions 53 (described later) of the sheet transport unit 50.

The second bearing portions 102 have long hole shapes being long in the up-down direction (Z and −Z directions) of the housing 100. The sheet transport unit 50 rotatably supported by the second bearing portions 102 may move in the up-down direction (Z and −Z directions) of the housing 100 within a range along the major axes of the long holes.

Recesses 103 serving as positioning portions are formed at the upper side (Z direction) of the first bearing portions 101 and the second bearing portions 102. Part at the rear side (−X direction) of each of the recesses 103 is opened. The recess 103 includes fixed surfaces 103*a* and 103*b* located in the front-rear direction (X and −X directions) and a fixed surface 103*c* at the upper side (Z direction). The distance between the fixed surfaces 103*a* and 103*b* located in the front-rear direction (X and −X directions) is set to be substantially equal to a sectional shape (dimension) of each of engagement protrusions 54 (described later) of the sheet transport unit 50.

That is, when the engagement protrusions 54 of the sheet transport unit 50 enter the recesses 103, side surfaces 54*a* located in the front-rear direction (X and −X directions) of the engagement protrusions 54 come into contact with the fixed surfaces 103*a* and 103*b* located in the front-rear direction (X and −X directions) of the recesses 103, and surfaces 54*b* at the upper side (Z direction) of the engagement protrusions 54 are positioned and regulated at the fixed surfaces 103*c*.

The sheet guide 23 serving as the first transport unit that guides the sheet, which is drawn to the front side (−X direction) by the sheet draw portion 22, to the pair of transport rollers 24 is fixed in the housing 100. The driving roller 24*a* that forms one of the pair of transport rollers 24 is rotatably supported at the sheet guide 23.

(2.2) Open and Close Panel

The open and close panel 110 includes the pair of left and right rotation shaft portions 111 at the lower end portion. The rotation shaft portions 111 are inserted and fitted to the first bearing portions 101 formed at the lower ends at the opening side of the both side plates 100*a* of the housing 100, and hence the open and close panel 110 is rotatable.

A pair of left and right lower holder portions 112 is formed at the inner surface side of the open and close panel 110 facing the housing 100. The lower holder portions 112 have guide grooves 112*a* with long hole shapes being long in the up-down direction (Z and −Z directions). Lower boss portions 66 (described later), which are formed at the transfer and transport unit 60, are inserted and fitted to the lower holder portions 112, and support the transfer and transport unit 60 movably in the up-down direction (Z and −Z directions).

Also, a pair of left and right upper holder portions 113 is formed at the upper side (Z direction) of the lower holder portions 112. The upper holder portions 113 have guide grooves 113*a* with long hole shapes being long in the up-down direction (Z and −Z directions). Upper boss portions 67 (described later), which are formed at the transfer and transport unit 60, are inserted and fitted to the upper holder portions 113, and support the transfer and transport unit 60 movably in the up-down direction (Z and −Z directions).

A pair of left and right protrusions 116 serving as guide portions is formed at the inner surface side of the open and close panel 110 facing the housing 100. The protrusions 116 include first tapered portions 116*a*, second tapered portions 116*b* continued to the first tapered portions 116*a*, and round-shape portions 116*c* continued to the second tapered portion 116*b*. The protrusions 116 come into contact with protrusions 55 serving as guided portions (described later), which are provided at the open and close panel 110 side of the sheet transport unit 50 to face the protrusions 116, in association with an open or close operation of the open and close panel 110. Thus, the sheet transport unit 50 is guided to the recesses 103 serving as the positioning portions.

(2.3) Sheet Transport Unit

The sheet transport unit 50 includes the sheet guide 51 and the driven roller 24*b* forming the pair of transport rollers 24. The sheet guide 51 has a sheet guide surface having plural guide ribs 52 formed thereon. The guide ribs 52 guide the sheet, which is stacked on the sheet stack plate 21 and drawn to the front side (−X direction) by the sheet draw portion 22, to the contact part of the pair of transport rollers 24.

The driven roller 24*b* is located at the downstream side (Z direction) of the sheet guide 51, is urged to protrude toward the sheet guide surface from the guide ribs 52 by a spring member S1, and is supported rotatably in the sheet transport direction.

The pair of left and right rotation shaft portions 53 is formed at both the side surfaces of the sheet guide 51. The rotation shaft portions 53 are inserted and fitted to the second bearing portions 102 formed at the both side plates 100*a* of the housing 100. The sheet transport unit 50 is movable with respect to the housing 100.

The rotation shaft portions 53 have columnar shapes. The outer diameter of each column is substantially equal to the width along the minor axis of each of the second bearing portions 102 formed in the long hole shapes being long in the up-down direction (Z and −Z directions) of the housing 100. The rotation shaft portions 53 rotate in association with the open or close operation of the open and close panel 110 with less rattling, and are movable in the up-down direction (Z and −Z directions) of the housing 100 within the range along the major axes of the long holes.

The axes of the rotation shaft portions 53, the rotation shaft portions 111, the pair of transport rollers 24, and the transfer roller 62 are parallel to each other.

The pair of left and right engagement protrusions 54 is formed at both the side surfaces of the sheet guide 51. The engagement protrusions 54 are inserted and fitted to the recesses 103 serving as the positioning portions formed at the both side plates 100*a* of the housing 100, the side surfaces 54*a* located in the front-rear direction (X and −X directions) of the engagement protrusions 54 come into contact with the fixed surfaces 103*a* and 103*b* located in the front-rear direction (X and −X directions) of the recesses 103, and the surfaces 54*b* at the upper side (Z direction) of the engagement protrusions 54 are positioned and regulated at the fixed surfaces 103*c*.

The pair of left and right protrusions 55 serving as the guided portions is formed at the other surface side of the sheet guide surface of the sheet guide 51, to face the protrusions 116 formed at the inner surface side of the open and close panel 110. When the open and close panel 110 is rotated, the protrusions 55 move while contacting the protrusions 116 of the open and close panel 110, and the sheet transport unit 50 is guided to the recesses 103 serving as the positioning portions.

(2.4) Transfer and Transport Unit

The transfer and transport unit 60 includes a transfer and transport housing 61 and the transfer roller 62. The transfer and transport housing 61 includes the sheet guide 63 that guides the sheet sent from the pair of transport rollers 24 to the transfer contact part, a transfer-roller holder portion 64 that holds the transfer roller 62, and the transport guide 65 that guides the sheet having the toner image formed thereon to the fixing unit 70, which are integrally formed.

The pair of left and right lower boss portions 66 is formed at both the side surfaces at the sheet guide 63 side of the transfer and transport housing 61. The lower boss portions 66 are inserted and fitted to the guide grooves 112*a* with the long hole shapes being long in the up-down direction (Z and −Z directions) and provided at the lower holder portions 112 of the open and close panel 110.

Also, the pair of left and right upper boss portions 67 is formed at both the side surfaces at the transport guide 65 side of the transfer and transport housing 61. The upper boss portions 67 are inserted and fitted to the guide grooves 113*a* with the long hole shapes being long in the up-down direction (Z and −Z directions) and provided at the upper holder portions 113 of the open and close panel 110.

Hence, the transfer and transport unit 60 is supported at the inner surface of the open and close panel 110 facing the housing 100, movably in the up-down direction (Z and −Z directions).

Both end portions of the transfer roller 62 are urged by spring members (not illustrated), at the transfer-roller holder portion 64 to come into contact with the photoconductor drum 31 through bearing members 68, and are rotatably supported at the transfer-roller holder portion 64 in the sheet transport direction. The bearing members 68 are positioned and engaged at hook portions 104 formed at the housing 100.

(3) Operation of Sheet Transport Section

With the sheet transport section configured as described above, for example, when a user removes a sheet clogged at the sheet transport section, the sheet transport unit 50 and the transfer and transport unit 60 are rotated from the housing 100 in association with the open operation of the open and close panel 110, and the contact state of the pair of transport rollers 24 is released.

Figure 4B:
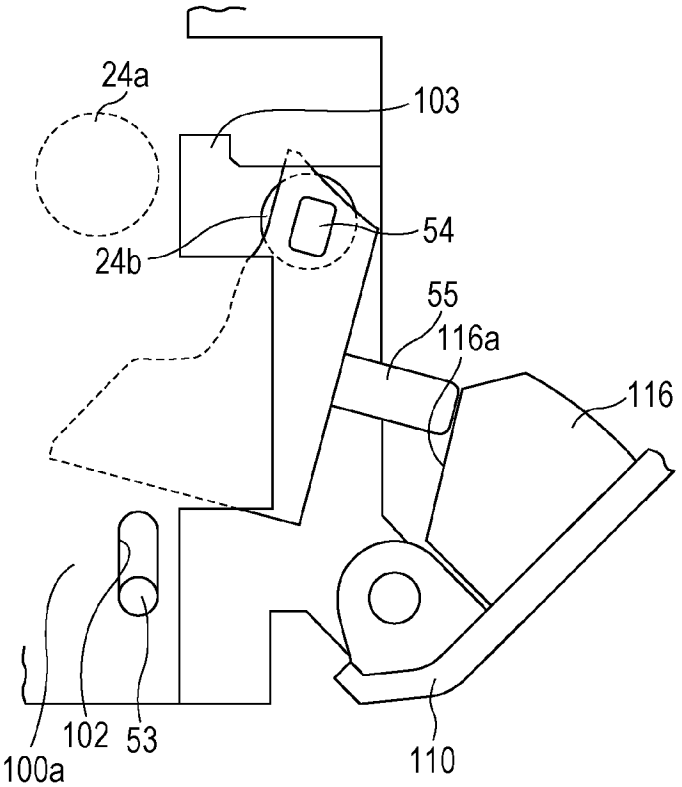
FIGS. 4A and 4B are schematic partial illustrations each explaining movement of a sheet transport unit by an open operation of an open and close panel.
Figure 4A:
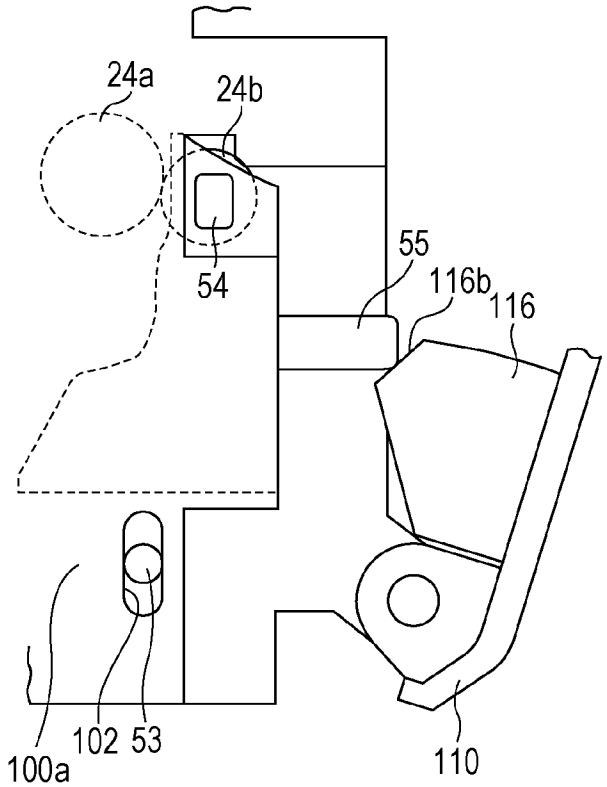
Figure 5A:
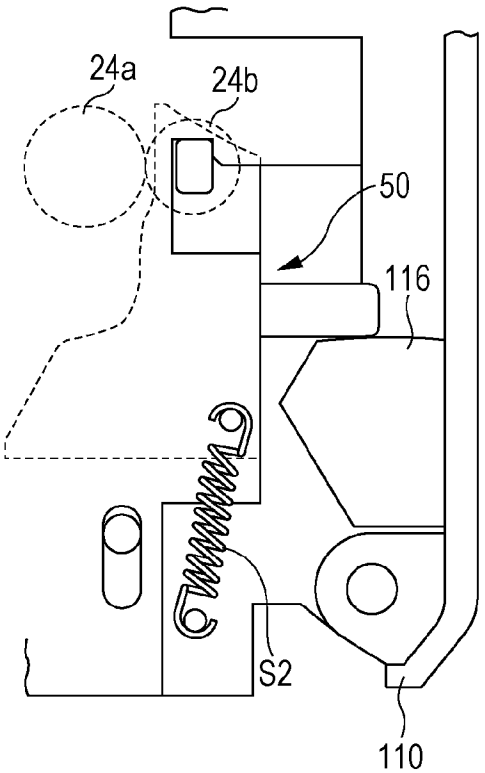
FIGS. 5A to 5C are schematic illustrations each explaining an example of a release structure of positioning engagement between an engagement protrusion and a recess.
Figure 5B:
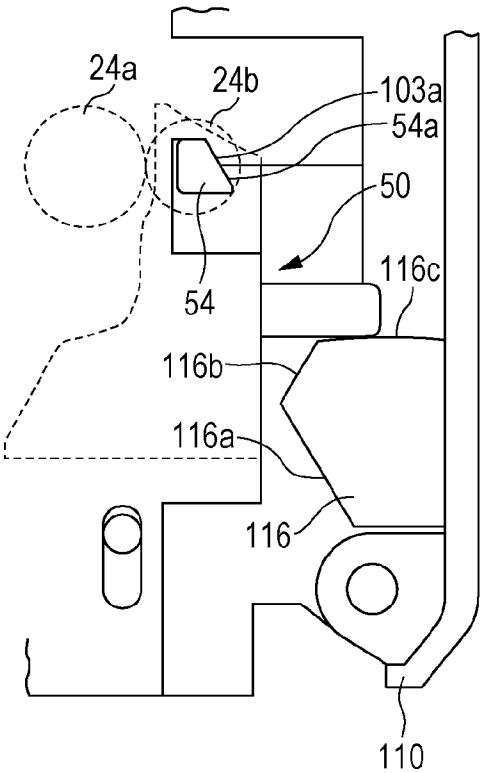
Figure 5C:
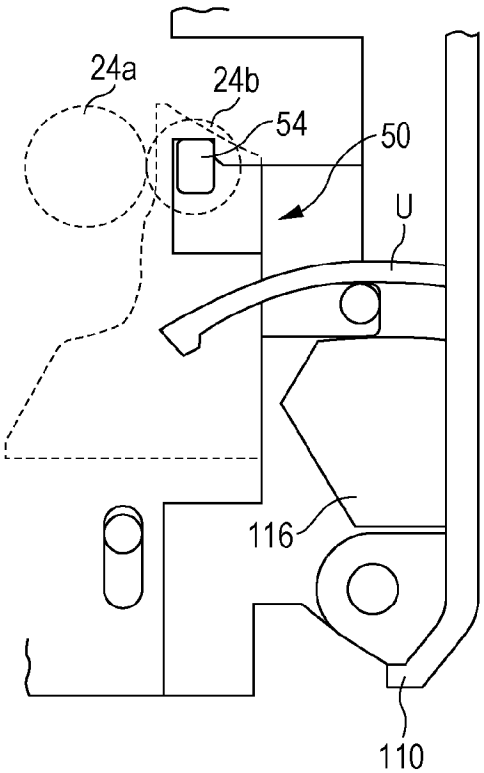
Figure 6A:
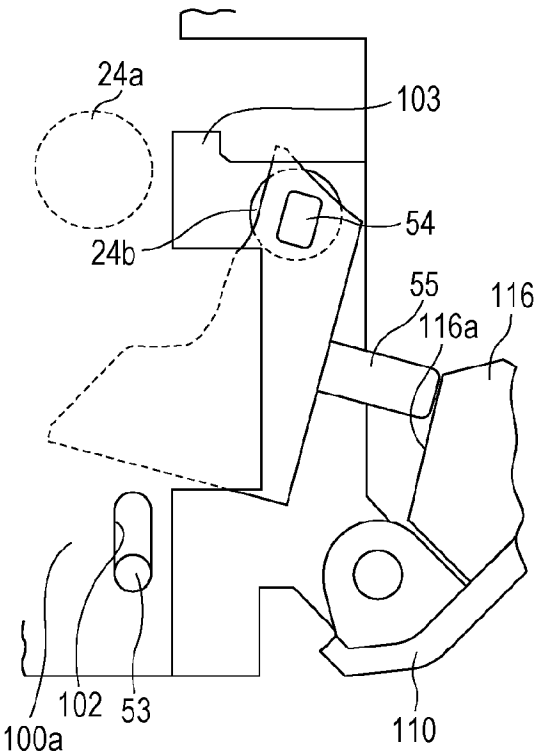
FIGS. 6A to 6C are schematic partial illustrations each explaining movement of the sheet transport unit caused by a close operation of the open and close panel.
Figure 6B:
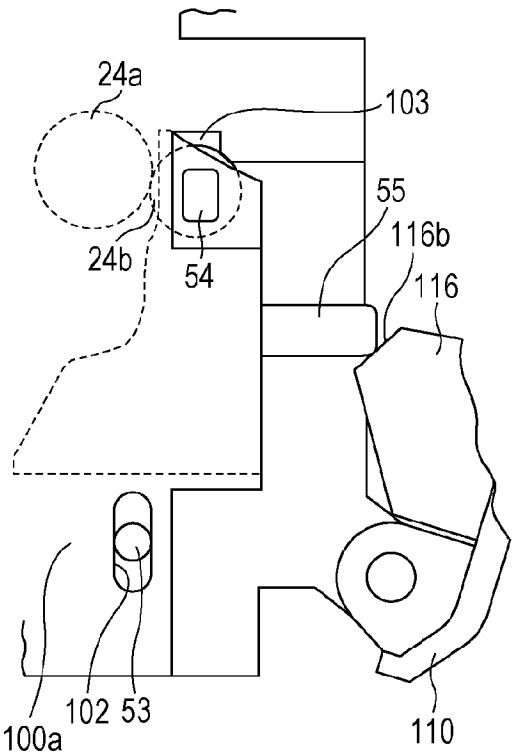
Figure 6C:
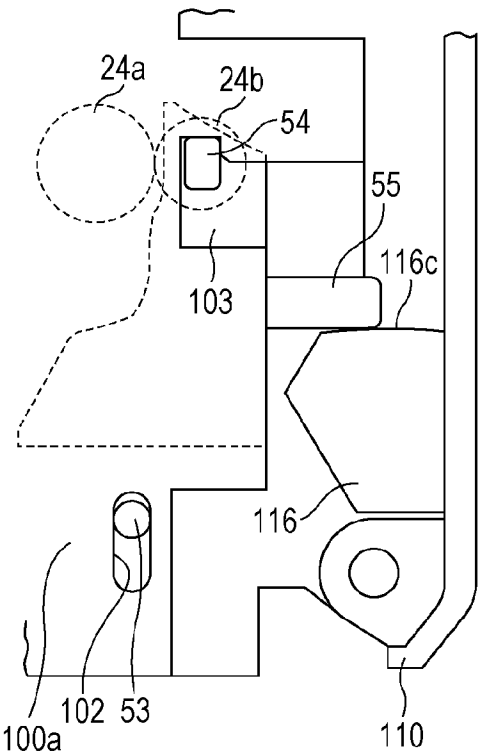
Figure 7B:
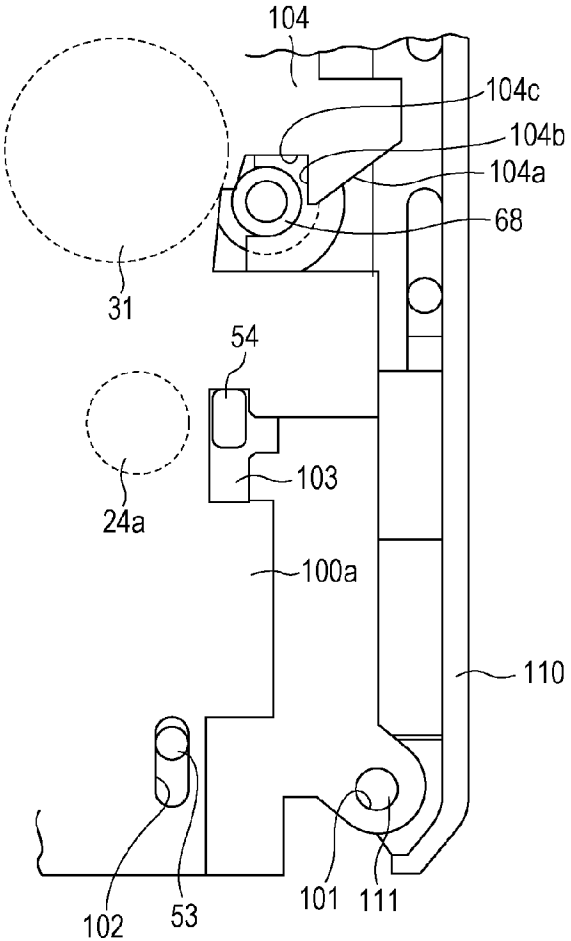
FIGS. 7A and 7B are schematic partial illustrations each explaining movement of a transfer and transport unit caused by the close operation of the open and close panel.
Figure 7A:
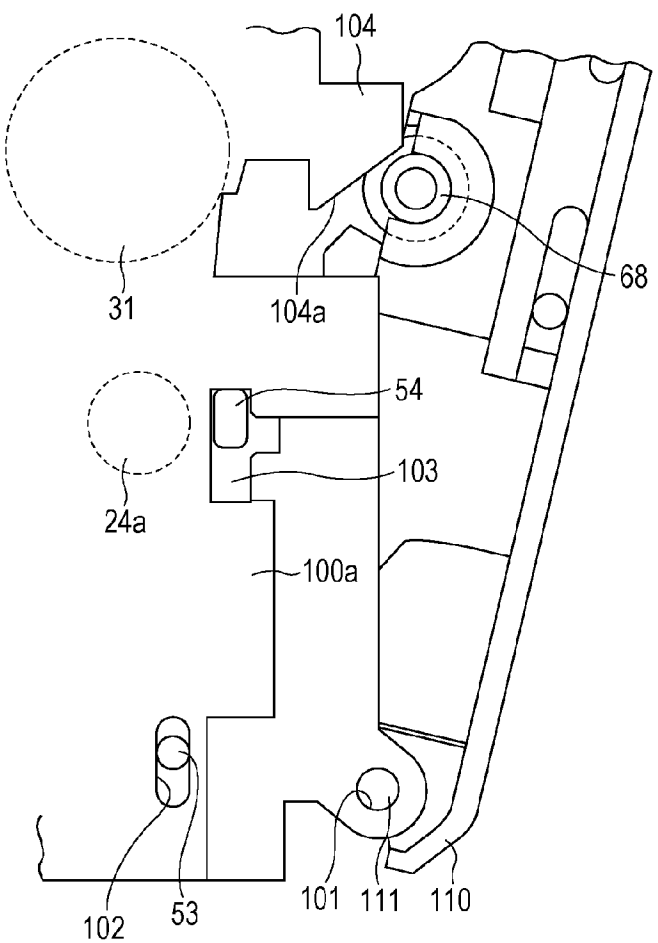

FIGS. 4A and 4B are schematic partial sections each explaining movement of the sheet transport unit 50 caused by the open operation of the open and close panel 110. FIGS. 5A to 5C are schematic illustrations each explaining an example of a release structure of positioning engagement between the engagement protrusions 54 and the recesses 103. FIGS. 6A to 6C are schematic partial illustrations each explaining movement of the sheet transport unit 50 caused by the close operation of the open and close panel 110. FIGS. 7A and 7B are schematic partial illustrations each explaining movement of the transfer and transport unit 60 caused by the close operation of the open and close panel 110.

When the open operation of the open and close panel 110 is started, the round-shape portions 116*c* of the open and close panel 110 pressing the protrusions 55 of the sheet transport unit 50 from the lower side move while contacting the protrusions 55, and then move to a position at which the protrusions 55 come into contact with the second tapered portions 116*b* continued to the round-shape portions 116*c* (see FIG. 4A).

Then, when the contact between the protrusions 55 and the second tapered portions 116*b* is ended, and the open and close panel 110 is opened to a position at which the protrusions 55 come into contact with the first tapered portions 116*a*, the engagement protrusions 54 of the sheet transport unit 50 move from the fixed surfaces 103*a* and 103*b* located in the front-rear direction (X and −X directions) of the recesses 103 to the open region, and the positioning engagement between the engagement protrusions 54 and the recesses 103 is released (see FIG. 4B).

The sheet transport unit 50 is moved by a reactive force of the contact received by the driven roller 24*b* forming the pair of transport rollers 24 in a direction in which the sheet guide 51 is separated, the contact between the pair of transport rollers 24 is released, and hence the clogged sheet may be easily removed.

It is to be noted that a force may be applied to the sheet transport unit 50 in a direction in which the contact between the pair of transport rollers 24 is released so that the contact between the pair of transport rollers 24 is reliably released when the open and close panel 110 moves to the open position. For example, a spring member S2 may be used to constantly urge the sheet transport unit 50 to the lower side (−Z direction) of the housing 100, so that the engagement protrusions 54 of the sheet transport unit 50 are reliably moved from the fixed surfaces 103*a* and 103*b* located in the front-rear direction (X and −X directions) of the recesses 103 to the open region and the positioning engagement between the engagement protrusions 54 and the recesses 103 is released (see FIG. 5A).

Alternatively, the fixed surfaces 103*a* of the recesses 103 and the side surfaces 54*a* of the engagement protrusions 54 may have tapered shapes, so that the positioning engagement between the engagement protrusions 54 and the recesses 103 is released by the reactive force of the contact received by the driven roller 24*b* forming the pair of transport rollers 24 (see FIG. 5B).

Still alternatively, a press-down protrusion U that comes into contact with the sheet transport unit 50 may be provided at the open and close panel 110, so that the sheet transport unit 50 is moved to the lower side by the press-down protrusion U at the open operation of the open and close panel 110 (see FIG. 5C).

When the open and close panel 110 is returned from the open position to the closed position, the user rotates the open and close panel 110 toward the housing 100.

The first tapered portions 116*a* of the protrusions 116 of the open and close panel 110 come into contact with the protrusions 55 of the sheet guide 51, and the sheet transport unit 50 starts rotating around the rotation shaft portions 53 rotatably supported at the second bearing portions 102 of the housing 100, toward the closed position of the housing 100 (see FIG. 6A).

Then, the sheet transport unit 50 is moved until the protrusions 55 of the sheet guide 51 are inserted and fitted to the recesses 103 while contacting the first tapered portions 116*a* of the open and close panel 110 by the movement of the open and close panel 110 to the closed position.

Then, the sheet transport unit 50 is positioned and held because the engagement protrusions 54 formed at both the side surfaces of the sheet guide 51 are inserted and fitted to the recesses 103 formed at the both side plates 100*a* of the housing 100 and serving as the positioning portions.

At this time, the driven roller 24*b* supported and urged to protrude from the guide ribs 52 of the sheet guide 51 to the sheet guide surface comes into contact with the driving roller 24*a* forming the pair of transport rollers 24, and a reactive force caused by the contact acts on the open and close panel 110.

The engagement protrusions 54 come into contact with the fixed surfaces 103*a* and 103*b* located in the front-rear direction (X and −X directions) and are regulated by the fixed surfaces 103*a* and 103*b* and move to come into contact with the fixed surfaces 103*c* located in the upper direction (Z direction) while contacting the second tapered portions 116*b* continued to the first tapered portions 116*a* (see FIG. 6B).

The rotation shaft portions 53 of the sheet transport unit 50 are moved in the up-down direction (Z and −Z directions) within the range along the major axis of the long holes of the second bearing portions 102 of the housing 100.

The sheet transport unit 50 is supported while the protrusions 55 are pressed to the upper side (Z direction) by the round-shape portions 116*c* continued to the second tapered portions 116*b*, and the sheet transport unit 50 is positioned and held at the recesses 103 of the housing 100 (see FIG. 6C).

At this time, the driven roller 24*b* supported and urged to protrude from the guide ribs 52 of the sheet guide 51 to the sheet guide surface comes into contact with the driving roller 24*a* forming the pair of transport rollers 24. The reactive force of the contact is received by the surfaces (103*a*) of the recesses 103 opposing the direction in which the driven roller 24*b* receives the force. Accordingly, the reactive force acting on the open and close panel 110 is decreased and hence the open and close panel 110 is not deformed.

That is, the recesses 103 have the fixed surfaces 103*a* that are orthogonal to the direction in which the driven roller 24*b* receives the force, and the fixed surfaces 103*a* receive the reactive force acting on the pair of transport rollers 24.

The reactive force of lifting the pair of transport rollers 24 to the upper side (Z direction) by the sheet transportation and the sheet transport unit 50 to the upper side (Z direction) by the frictional force of the sheet is received by the recesses 103. The reactive force acting on the open and close panel 110 is decreased, and the open and close panel 110 is not deformed.

That is, the recesses 103 have the fixed surfaces 103*c* that are orthogonal to the direction in which the driven roller 24*b* receives the force by the sheet transportation, and the fixed surfaces 103*c* receive the force acting on the driven roller 24*b*. Accordingly, the recesses 103 regulate the movement of the driven roller 24*b* in the Z direction.

Hence, the recesses 103 position the sheet transport unit 50 located at the closed position in the upper direction (Z direction) and the front-rear direction (X and −X directions), and the open and close panel 110 supports the gravity (−X direction) acting on the sheet transport unit 50.

At the timing at which the sheet transport unit 50 is positioned at the recesses 103 serving as the first positioning portions of the housing 100, in the transfer and transport unit 60 supported at the inner surface side of the open and close panel 110 movably in the up-down direction (Z and −Z directions), the bearing members 68 provided at both the end portions of the transfer roller 62 come into contact with tapered portions 104*a* of the hook portions 104 serving as positioning portions formed at the housing 100 (see FIG. 7A).

Then, by the movement of the open and close panel 110 to the closed position, the bearing members 68 of the transfer roller 62 slide and move while contacting the tapered portions 104*a*, and are positioned and regulated at fixed surfaces 104*b* and 104*c* of the hook portions 104 (see FIG. 7B).

At this time, the transfer roller 62 urged to come into contact with the photoconductor drum 31 by the spring member (not shown) comes into contact with the photoconductor drum 31 and forms the transfer part. The reactive force of the contact acts on the open and close panel 110.

The protrusions 55 are supported by the round-shape portions 116*c* continued to the second tapered portions 116*b* of the open and close panel 110. The sheet transport unit 50 is held at the recesses 103 of the housing 100.

As described above, when the open and close panel 110 is returned from the open position to the closed position, the sheet transport unit 50 and the transfer and transport unit 60 forming the sheet transport section are engaged at the housing 100, and do not simultaneously form nip parts that cause the reactive forces to act on the open and close panel 110.

That is, when the open and close panel 110 moves to the closed position, the sheet transport unit 50 engages with the recesses 103 of the housing 100 and is positioned, and then the transfer and transport unit 60 engages with the hook portions 104 of the housing 100 and is positioned. Hence, the reactive forces caused by the nip parts acting on the open and close panel 110 are dispersed, and the close operation of the open and close panel 110 may be easily performed.

Also, when the open and close panel 110 moves to the closed position, the reactive forces received from the sheet transport unit 50 and the transfer and transport unit 60 are dispersed, and breakage of the open and close panel 110 may be restricted.

Second Exemplary Embodiment

An image forming apparatus 1A according to this exemplary embodiment has a basic configuration similar to the image forming apparatus 1A according the first exemplary embodiment, except a structure of a recess 103A serving as a positioning portion. Therefore, the same reference sings are applied to components common to the components of the image forming apparatus 1 of the first exemplary embodiment, and the detailed description is omitted.

(1) Configuration and Close Operation of Sheet Transport Section

Figure 8:
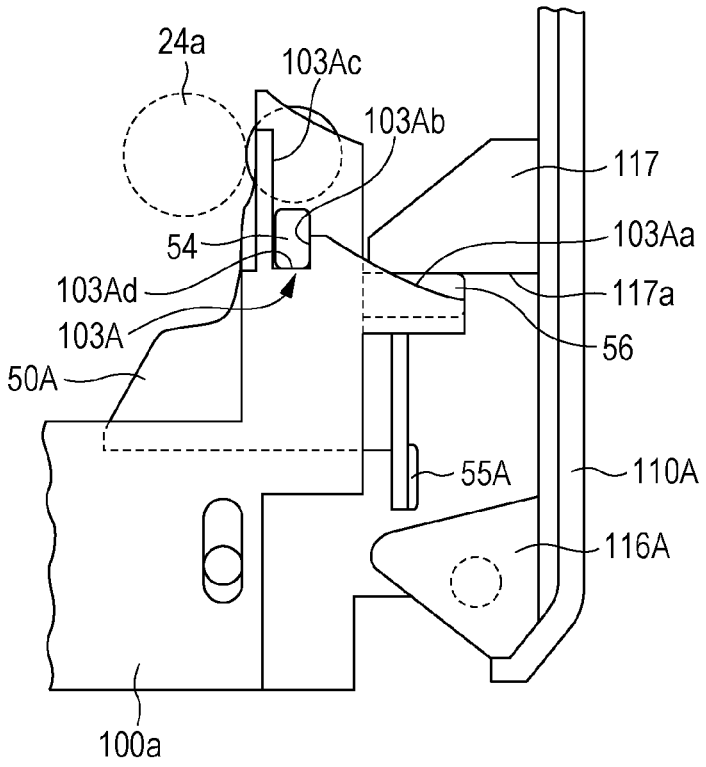
FIG. 8 is a schematic partial section illustrating a sheet transport section of an image forming apparatus.
Figure 9B:
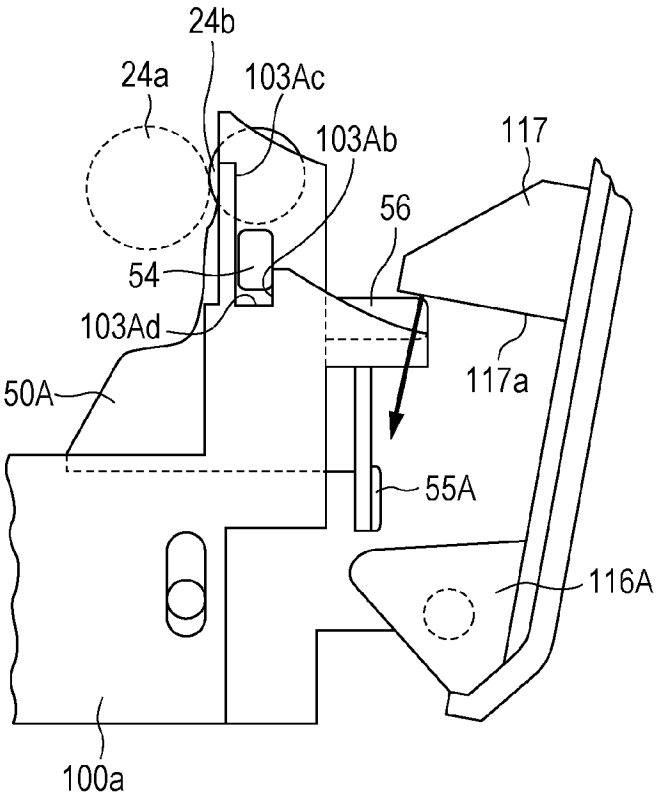
FIGS. 9A and 9B are schematic partial illustrations each explaining movement of a sheet transport unit by a close operation of an open and close panel.
Figure 9A:
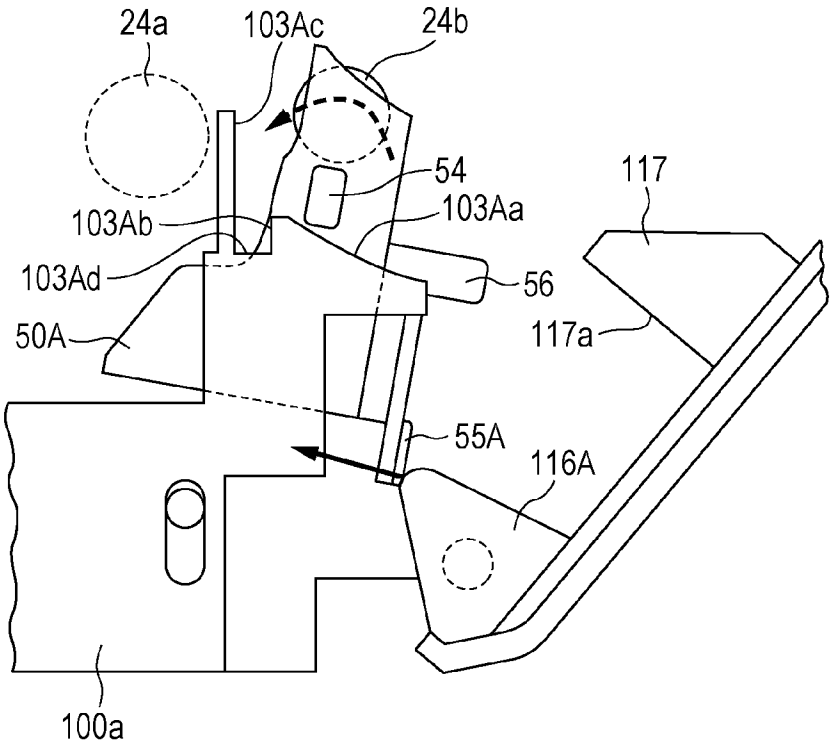

FIG. 8 is a schematic partial section of the sheet transport section, and FIGS. 9A and 9B are schematic partial illustrations each explaining movement of a sheet transport unit 50A by a close operation of an open and close panel 110A. A configuration of the sheet transport section of the image forming apparatus 1A and the close operation of the open and close panel 110A are described below with reference to the drawings.

The sheet transport section includes the housing 100, the open and close panel 110A, the sheet transport unit 50A, and the transfer and transport unit 60. The recesses 103A serving as positioning portions of the housing 100, first protrusions 116A serving as guide portions of the open and close panel 110A, and the sheet guide 51 of the sheet transport unit 50A are described below in detail.

(1.1) Housing

The housing 100 has an opening at the rear side (−X direction) and houses the photoconductor unit 30 and the development unit 40 in the opening.

The housing 100 includes both side plates 100*a*. The first bearing portions 101 serving as the rotation center of the open and close panel 110A are formed at lower ends at the opening side of the both side plates 100*a* to penetrate through the both side plates 100*a* in a plate thickness direction. The first bearing portions 101 rotatably support the rotation shaft portions 111 (described later) of the open and close panel 110A.

The second bearing portions 102 are formed at the front side (X direction) of the first bearing portions 101. The second bearing portions 102 rotatably support the rotation shaft portions 53 of the sheet transport unit 50A.

The recesses 103A serving as positioning portions are formed at the upper side (Z direction) of the first bearing portions 101 and the second bearing portions 102. As shown in FIG. 8, each of the recesses 103A includes a tapered portion 103Aa, fixed surfaces 103Ab and 103Ac located in the front-rear direction (X and −X directions), and a fixed surface 103Ad at the lower side (−Z direction). Part at the upper side (Z direction) of the recess 103A is opened.

The engagement protrusions 54 of the sheet transport unit 50A are guided to the tapered portions 103Aa, and are positioned and regulated at the fixed surfaces 104*b* and 104*c*.

To be more specific, the distance between the fixed surfaces 103Ab and 103Ac located in the front-rear direction (X and −X directions) is set to be substantially equal to the sectional shape (dimension) of each of the engagement protrusions 54 of the sheet transport unit 50A.

When the engagement protrusions 54 of the sheet transport unit 50A are fitted to the recesses 103A while contacting the tapered portions 103Aa, the side surfaces 54*a* located in the front-rear direction (X and −X directions) of the engagement protrusions 54 come into contact with the fixed surfaces 103Ab and 103Ac located in the front-rear direction (X and −X directions) of the recesses 103A, and the surfaces 54*b* in the lower direction (−Z direction) of the engagement protrusions 54 are positioned and regulated at the fixed surfaces 103Ad.

(1.2) Open and Close Panel

The open and close panel 110A includes the pair of left and right rotation shaft portions 111 at the lower end portion. The rotation shaft portions 111 are inserted and fitted to the first bearing portions 101 formed at the lower ends at the opening side of the both side plates 100*a* of the housing 100, and hence the open and close panel 110A is rotatable.

A pair of left and right protrusions 116A serving as guide portions is formed at the inner surface side of the open and close panel 110A facing the housing 100. The first protrusions 116A contact first protrusions 55A provided at the open and close panel 110A side of the sheet transport unit 50A to face the first protrusions 116A and serving as guided portions, in association with the open or close operation of the open and close panel 110A. The sheet transport unit 50A is guided to the recesses 103A serving as the positioning portions.

A pair of left and right second protrusions 117 is formed at the inner surface side of the open and close panel 110A facing the housing 100, at the outside of the first protrusions 116A. The second protrusions 117 have pressing portions 117*a*. The pressing portions 117*a* contact second protrusions 56 provided at the open and close panel 110A side of the sheet transport unit 50A to face the second protrusions 117, in association with the open or close operation of the open and close panel 110A. The sheet transport unit 50A is pressed to the fixed surfaces 103Ad of the recesses 103A serving as the positioning portions and is positioned.

(1.3) Sheet Transport Unit

The sheet transport unit 50A includes the sheet guide 51 and the driven roller 24*b* forming the pair of transport rollers 24. The sheet guide 51 has the sheet guide surface having the plural guide ribs 52 formed thereon. The guide ribs 52 guide the sheet, which is stacked on the sheet stack plate 21 and drawn to the front side (−X direction) by the sheet draw portion 22, to the contact part of the pair of transport rollers 24.

The driven roller 24*b* is located at the downstream side (Z direction) of the sheet guide 51, is urged to protrude toward the sheet guide surface from the guide ribs 52 by the spring member S1, and is supported rotatably in the sheet transport direction.

The pair of left and right rotation shaft portions 53 is formed at both the side surfaces of the sheet guide 51. The rotation shaft portions 53 are inserted and fitted to the second bearing portions 102 formed at the both side plates 100*a* of the housing 100. The sheet transport unit 50A is movable with respect to the housing 100.

The pair of left and right engagement protrusions 54 is formed at both the side surfaces of the sheet guide 51. The engagement protrusions 54 are inserted and fitted to the recesses 103A serving as the positioning portions formed at the both side plates 100*a* of the housing 100, the side surfaces 54*a* located in the front-rear direction (X and −X directions) of the engagement protrusions 54 come into contact with the fixed surfaces 103Ab and 103Ac located in the front-rear direction (X and −X directions) of the recesses 103A, and the surfaces 54*b* at the lower side (−Z direction) of the engagement protrusions 54 are supported at the fixed surfaces 103Ad, and are positioned and regulated at the fixed surfaces 103Ad.

The pair of left and right first protrusions 55A serving as the guided portions is formed at the other surface side of the sheet guide surface of the sheet guide 51, to face the first protrusions 116A formed at the inner surface side of the open and close panel 110A. The first protrusions 55A move while contacting the first protrusions 116A of the open and close panel 110A by the rotation of the open and close panel 110A, and are guided to the recesses 103A serving as the positioning portions of the sheet transport unit 50A (see FIG. 9A).

The pair of left and right second protrusions 56 is formed at the outside of the first protrusions 55A to face the second protrusions 117 of the open and close panel 110A. The second protrusions 56 come into contact with the pressing portions 117*a* of the second protrusions 117 provided at the open and close panel 110A, in association with the close operation of the open and close panel 110A (see FIG. 9B). The sheet transport unit 50A is positioned and held in a state in which the sheet transport unit 50A is pressed to the fixed surfaces 103Ad of the recesses 103A serving as the positioning portions.

(2) Operation

When the engagement protrusions 54 of the sheet transport unit 50A move while contacting the tapered portions 103Aa and are fitted to the recesses 103A, the side surfaces 54*a* located in the front-rear direction (X and −X directions) of the engagement protrusions 54 come into contact with the fixed surfaces 103Ab and 103Ac located in the front-rear direction (X and −X directions) of the recesses 103A.

Then, the surfaces 54*b* located in the lower direction (−Z direction) of the engagement protrusions 54 are supported at the fixed surfaces 103Ad, and are positioned and held in a state in which the surfaces 54*b* are pressed by the pressing portions 117*a* of the second protrusions 117 of the open and close panel 110A.

Hence, the driven roller 24*b* supported and urged to protrude from the guide ribs 52 of the sheet guide 51 to the sheet guide surface comes into contact with the driving roller 24*a* forming the pair of transport rollers 24, and forms the contact. The reactive force of the contact is received by the recesses 103A. Accordingly, the reactive force acting on the open and close panel 110A is decreased and hence the open and close panel 110A is not deformed.

That is, the recesses 103A have the fixed surfaces 103Ab that are orthogonal to the direction in which the driven roller 24*b* receives the force, and the fixed surfaces 103Ab receive the reactive force acting on the pair of transport rollers 24.

The reactive force of lifting the pair of transport rollers 24 by the sheet transportation and the sheet transport unit 50A by the frictional force of the sheet is received by the rotation shaft portions 111 of the open and close panel 110A through the pressing portions 117*a* of the second protrusions 117 provided at the open and close panel 110A. Accordingly, the reactive force of pressing the open and close panel 110A to the outside (−X direction) of the image forming apparatus 1A is decreased, and the open and close panel 110A is not deformed.

Further, since the recesses 103A are opened in the upper direction (Z direction), when a sheet clogged in the pair of transport rollers 24 is pulled, the driven roller 24*b* is moved by the sheet, and the contact between the pair of transport rollers 24 is released.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transport device, comprising:

a device body configured to transport a sheet;

a pair of transport rollers configured to come into contact with each other and configured to transport the sheet toward a downstream side in a transport direction of the sheet;

a guide member configured to guide the sheet toward the pair of transport rollers; and an open and close member configured to open and close a side surface of the device body, wherein one of the pair of transport rollers is provided at the device body and the other transport roller is provided at the guide member, and the guide member is configured to rotate about a first axis parallel to an axis about which at least one of the pair of transport rollers is rotatable, and wherein, in response to the open and close member rotating to an open position at which the side surface is open, the open and close member is configured to rotate about a second axis and the contact between the pair of transport rollers is allowed to be released, wherein the device body includes a positioning portion configured to position the guide member, wherein, in response to the open and close member rotating about the second axis from the open position to a closed position at which the side surface is closed, the open and close member is configured to move the guide member into an engagement position at which the guide member is engaged with the positioning portion, wherein, in response to the open and close member rotating about the second axis from the closed position to the open position, the guide member is configured to move from the engagement position to a separate position at which the guide member is separated from the positioning portion, wherein the first axis is movable in a plane crossing through the axis of rotation of at least one of the pair of transport rollers.

2. The sheet transport device according to claim 1, further comprising a force applying portion configured to apply a force, in response to the open and close member moving to the open position, in a direction in which the contact between the pair of transport rollers is released.

3. The sheet transport device according to claim 1, wherein, in a state in which the guide member is moved into the engagement position, the positioning portion has a surface configured to oppose a reactive force caused by the contact between the pair of transport rollers.

4. The sheet transport device according to claim 1, wherein, in a state in which the guide member is moved into the engagement position, the positioning portion has a surface configured to regulate movement of the other transport roller toward the downstream side in the transport direction of the sheet.

5. The sheet transport device according to claim 1, wherein, in a state in which the guide member is moved into the engagement position, the open and close member is configured to be supported at a portion thereof located at an upstream side in the transport direction of the sheet with respect to the pair of transport rollers.

* * * * *